US005548945A

United States Patent [19]

Nippes

[11] Patent Number: 5,548,945

[45] Date of Patent: Aug. 27, 1996

[54] DEVICE FOR PACKING STACKS OF FILLED TEA BAGS

[75] Inventor: Helmut Nippes, Solingen, Germany

[73] Assignee: Teepack Spezialmaschinen GmbH & Co. KG, Meerbusch, Germany

[21] Appl. No.: 353,113

[22] Filed: Dec. 9, 1994

[30] Foreign Application Priority Data

Dec. 10, 1993 [DE] Germany ..... 43 42 112.1

[51] Int. Cl.[6] ..... G65B 35/30

[52] U.S. Cl. ..... 53/540; 53/247; 53/542

[58] Field of Search ..... 53/247, 531, 540, 53/542, 544, 134.2

[56] References Cited

U.S. PATENT DOCUMENTS

| | | | |
|---|---|---|---|
| 2,834,164 | 5/1958 | Irmscher | 53/134.2 X |
| 2,860,460 | 11/1958 | Rambold | 53/544 X |
| 2,941,676 | 6/1960 | Harker | 53/542 X |
| 3,435,584 | 4/1969 | Prechter | 53/542 X |
| 3,812,643 | 5/1974 | Vergobbi | 53/540 X |
| 3,815,316 | 6/1974 | Brooke | 53/252 X |
| 4,052,838 | 10/1977 | Hilton et al. . | |
| 4,209,960 | 7/1980 | Deutschlander et al. | 53/542 X |
| 4,250,689 | 2/1981 | van Cutsem | 53/542 X |
| 4,398,383 | 8/1983 | Prakken . | |
| 4,590,743 | 5/1986 | Hardage | 53/542 X |
| 4,951,448 | 8/1990 | Schmechel | 53/542 X |

FOREIGN PATENT DOCUMENTS

| | | |
|---|---|---|
| 1800245 | 10/1969 | Germany . |
| 2412063 | 9/1974 | Germany . |

*Primary Examiner*—Linda Johnson
*Assistant Examiner*—Daniel Moon
*Attorney, Agent, or Firm*—Robert W. Becker & Associates

[57] ABSTRACT

A device for packing packs of filled tea bags has a channel for collecting filled tea bags to form a stack. The channel has a first stack holder for securing the leading tea bag and a first stack pusher for advancing the completed stack. A rotary device has two cassettes for receiving the completed stack. A transporting device has a second stack holder and a second stack pusher for transporting the completed stack from the rotary device after rotation into a position above the box for packing. A pushing device for pushing the completed stack into the box is provided. A tea bag feeding device feeds individual tea bags to the channel for forming the stack. Two oppositely arranged retaining fingers are positioned at an upstream end of the channel. A tea bag holder is positioned in an initial position at the beginning of forming a new stack at the upstream end of the channel and is displaceable in the longitudinal direction of the channel. The tea bags fed to the device by the tea bag feeding device are positioned between the retaining fingers and the tea bag holder.

11 Claims, 5 Drawing Sheets

DEVICE FOR PACKING STACKS OF FILLED TEA BAGS

BACKGROUND OF THE INVENTION

Devices for packing stacks (groups) of filled tea bags in which a stack of tea bags is fixed within a channel by a stack holder and a stack pusher are known. The devices have a rotor arranged downstream of the channel with at least two cassettes for receiving the fixed stack of tea bags and further have a transport device comprising a further stack holder and a further stack pusher for transporting the stack of tea bags from the rotated cassette into a position above a packing box. A pushing device for pushing the stack of tea bags into the box is also provided.

In a device disclosed in German Offenlegungsschrift 24 12 063 the filled tea bags are transported in an upright position by a feeding device, are separated into groups by separating elements, and are then engaged serially by stack holders and stack pushers. After transfer to the cassette the stack of tea bags is rotated, shook, and compressed before being pushed into the waiting packing box. In this manner it is to be achieved that the contents of the tea bag is substantially uniformly distributed and compacted to such a degree that the stack of tea bags fits into a box of a predetermined length.

In general, such a device is designed for packing stacks of tea bags of the same size with a predetermined number of tea bags. In order to adjust, if needed, the number of tea bags of a stack to the corresponding available volume of the box to be used, long change-over times are required which result in long and undesirable downtimes for the machine. Furthermore, it should be noted that the conditions for maintaining an optimal distribution of the tea bag contents constantly change as the number of tea bags of a stack changes and also as a function of the consistency (quality) of the tea so that for a high machine output only a limited amount of time is available to adjust the known devices to the changing conditions. Disturbances of the production therefore can be hardly avoided, even with such complicated measures as the additional shaking of the tea bags in the cassettes.

From German Offenlegungschrift 18 00 245 a further device for forming stacks of tea bags and for insertion of the stacks into packing boxes is known. This device places the tea bags within one stack alternatingly upright and upside down. Thus, the stack forms within the box a compact shape on edge which however requires some adjustment by the customer since every other tea bag is upside down when removed from the box. With this known device changes of the number of tea bags within one stack can only be achieved with great difficulties.

It is therefore an object of the present invention to provide a device of the aforementioned kind with which changes of the number of tea bags within a stack for an optimal use of the available space within the box is possible without problems whereby a substantially uniform tea distribution in the tea bags should be maintained during the entire packaging process.

SUMMARY OF THE INVENTION

The device for packing stacks of filled tea bags according to the present invention is primarily characterized by:

A channel for collecting filled tea bags to form a stack;

The channel having a first stack holder for securing the leading tea bag and a first stack pusher for advancing the completed stack;

A rotary device having at least two cassettes for receiving the completed stack;

A transporting device comprised of a second stack holder and a second stack pusher for transporting the completed stack after rotation from the rotary device into a position above a box for packing the completed stack;

A pushing device for pushing the completed stack into the box for packing;

A tea bag feeding device for individually feeding the tea bags to the channel for forming the stack;

Two oppositely arranged retaining fingers positioned at an upstream end of the channel; and A tea bag holder positioned in an initial position at the beginning of forming a new stack at the upstream end of the channel, the tea bag holder displaceable in the longitudinal direction of the channel, wherein the tea bags fed to the device by the tea bag feeding device are positioned between the retaining fingers and the tea bag holder.

Advantageously, the tea bag holder is friction-dampened and has two holding fingers laterally projecting into the channel from opposite sides of the channel.

Preferably, each one of the holding fingers has a glide element and the channel has on each of the opposite sides a brake rail. Each one of the glide elements is pressed onto the corresponding one of the brake rails.

Expediently, each one of the brake rails is concave and has at an upstream end thereof at least one transverse groove.

Preferably, the tea bag holder is displaceable between the initial position and a preset end position in which the tea bag holder releases the stack and returns to the initial position.

Advantageously, the first and the second stack holders are friction-dampened.

In a preferred embodiment of the present invention, the channel has lateral guide rails extending in the longitudinal direction of the channel.

In another embodiment of the present invention, the at least two cassettes are staggered about the rotational axis of the rotor at an angular distance.

Preferably, each one of the at least two cassettes has pairs of lateral holders wherein a first pair of the lateral holders, positioned upstream in each cassette, is stationary and a second pair of lateral holders, positioned downstream relative to the first pair, is position-adjustable in the longitudinal direction of each cassette.

Advantageously, the device further comprises a forceps-shaped gripping device upstream of the tea bag feeding device for removing the tea bags upside down from a tea packing machine. Preferably, the device further comprises a support rail positioned in the path of movement of the gripping device upstream of the channel and arranged in the same plane as a lower support surface of the channel.

The advantages that can be achieved with the present invention are the following. The stack of tea bags is formed within the channel by feeding individual tea bags into the channel that are at any time held in an upright position between the retaining fingers and the longitudinally displaceable tea bag holder. In this manner, an exact separation and fixation of the tea bags and the resulting stacks are ensured even at high machine output. Accordingly, the number of tea bags of one stack can be changed as desired without requiring any additional measures or changes at the components of the device. Furthermore, independent of the volume of the tea and the predetermined number of tea bags, a uniform and substantially pressure-free fixation of the stack is ensured which is beneficial for the tea contained in the tea bag as well as for the material from which the tea bags are made. This beneficial fixation remains throughout the entire packaging process so that the available volume of the boxes can be used in an optimal manner.

By providing a friction-dampened tea bag holder with two holding fingers laterally projecting into the channel from opposite sides of the channel, wherein each one of the holding fingers has a glide element and the channel has on opposite sides a brake rail onto which the glide elements are pressed and by providing brake rails that are concave and have at an upstream end thereof at least one transverse groove, by further providing that the tea bag holder is displaceable between the initial position and a preset end position in which the tea bag holder releases the stack and returns to the initial position, by having the first and second stack holders also friction-dampened and by providing the channel with lateral guide rails extending in the longitudinal direction of the channel, an additional stabilizing effect during the stack formation up to the point of transfer to the stack holder and stack pusher for transferring the completed stack from the Channel into the cassette arranged downstream is provided. The design of the rotor with at least two cassettes staggered about the rotational axis of the rotor at an angular distance and the design of each of the cassettes so as to have pairs of lateral holders wherein the first pair, positioned upstream in each cassette, is stationary and the second pair positioned downstream of the first pair is position-adjustable in the longitudinal direction of each cassette provides constructive measures with which in the transition zone of the device between formation of a stack and pushing of a stack into a box a stable fixation of the tea bags is maintained and idle time is avoided. By providing a forceps-shaped gripping device upstream of the tea bag feeding device for removing the tea bag upside down from a tea packing machine and by further providing a support rail, positioned in the path of movement of the gripping device upstream of the channel and arranged in the same plane as a lower support surface of the channel, it is possible to couple the inventive device to a conventional tea packing machine whereby it must be substantially ensured that the required change of the path of movement does not result in a one-sided displacement of the tea in the interior of the tea bag removed at high velocity from the tea packing machine.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
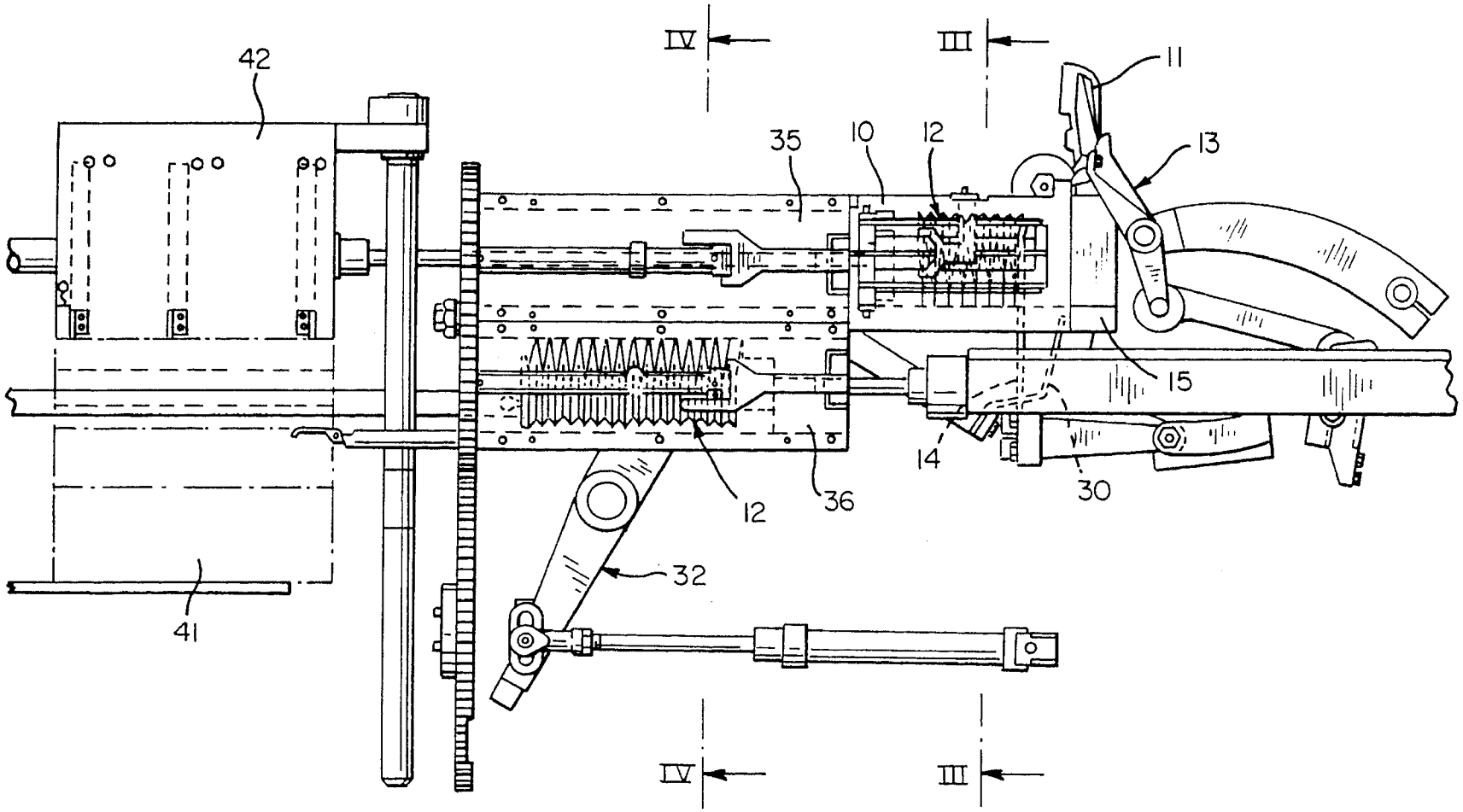
FIG. 1 is a side view of the inventive device showing schematically the operation.
Figure 2:
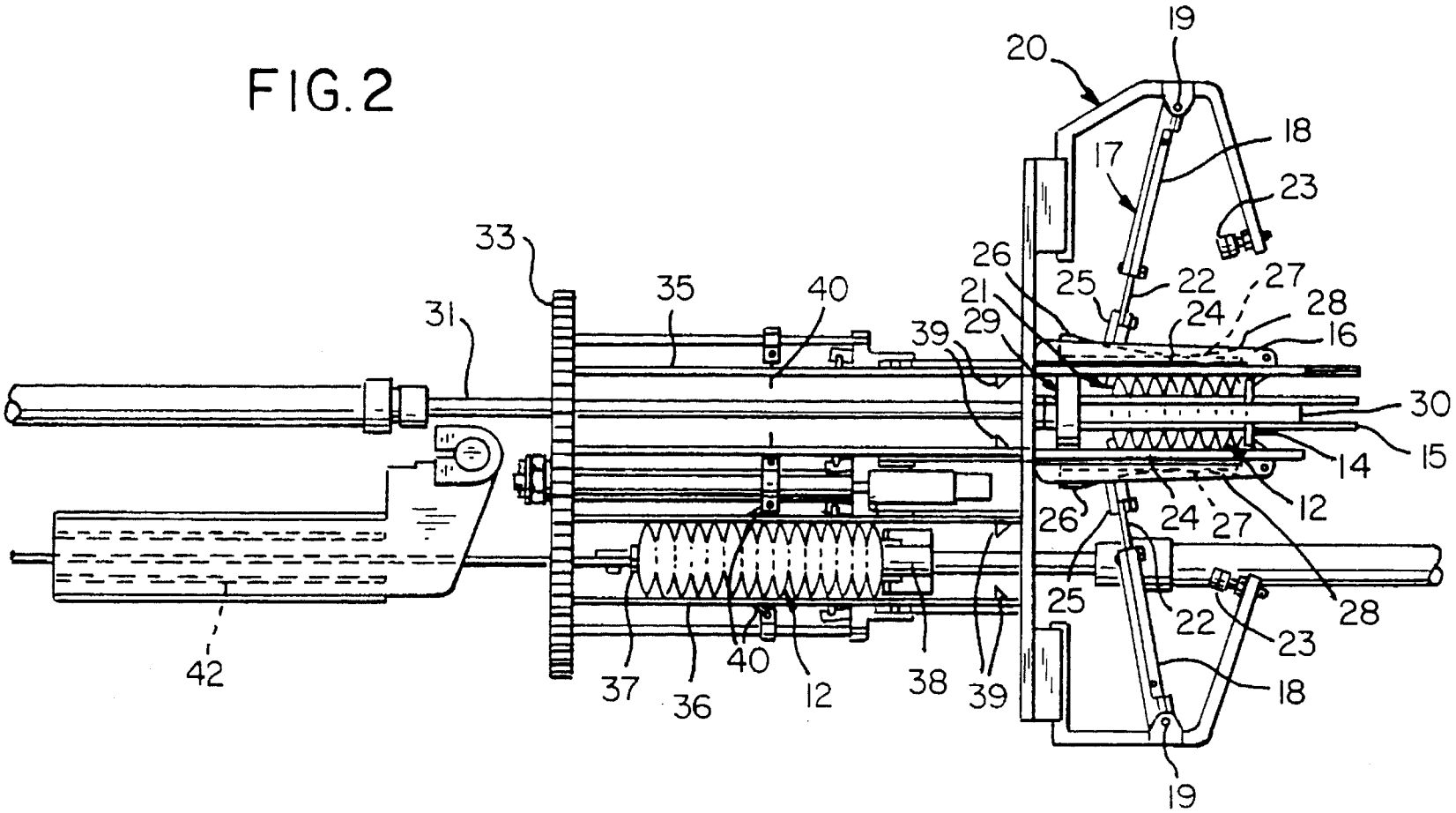
FIG. 2 shows the device of FIG. 1 in a top view.
Figure 3:
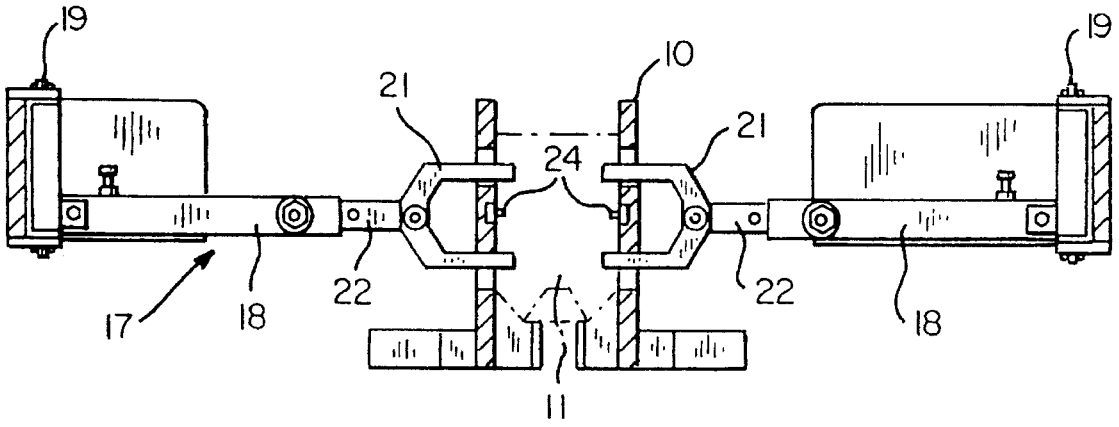
FIG. 3 shows a section along the line III—III of FIG. 1.

The present invention will now be described in detail with the aid of several specific embodiments utilizing the FIGS. 1 through 6.

The device schematically represented in the drawing has a channel 10 with a rectangular cross-section for forming and receiving the stack 12 of a plurality of filled tea bags 11. The tea bags 11 are transported individually with the aid of a forceps-shaped gripping device 13 from a tea packing machine of conventional design (not represented) arranged upstream and is further transported into the channel 10 with a tea bag feeding device 14. The gripping device 13 cooperates with a support rail 15 that is arranged upstream of the channel 10 at the same plane as the lower support surface thereof. In the interior of the channel 10 two oppositely arranged retaining fingers 16 are provided at the upstream end of the channel 10 which in the longitudinal direction are stationary but transverse to the longitudinal direction are arranged so as to be spring-elastical in the outward direction. They also have a slanted surface 16a in the advancing direction of the tea bags 11. For holding the tea bags 11, respectively, the stack 12 formed by the tea bags 11 in the advancing direction, a tea bag holder 17 is provided that has two arms 18 pivotably connected at pivot 19 to a stationary holder 20. The free ends of the arms 18 are provided with fork-shaped fingers 21 that are connected to the ends of a piston rod 22 guided within the arms 18. The arm 18 and the piston rod 22 form a piston cylinder unit that is preferably connected to a compressed air source. The arms 18 of the tea bag holder 17 are pivotable between an initial position in which they rest under the force of a spring at an abutment 23 and an end position which is variable as a function of the desired number of tea bags within a stack.

Figure 5:
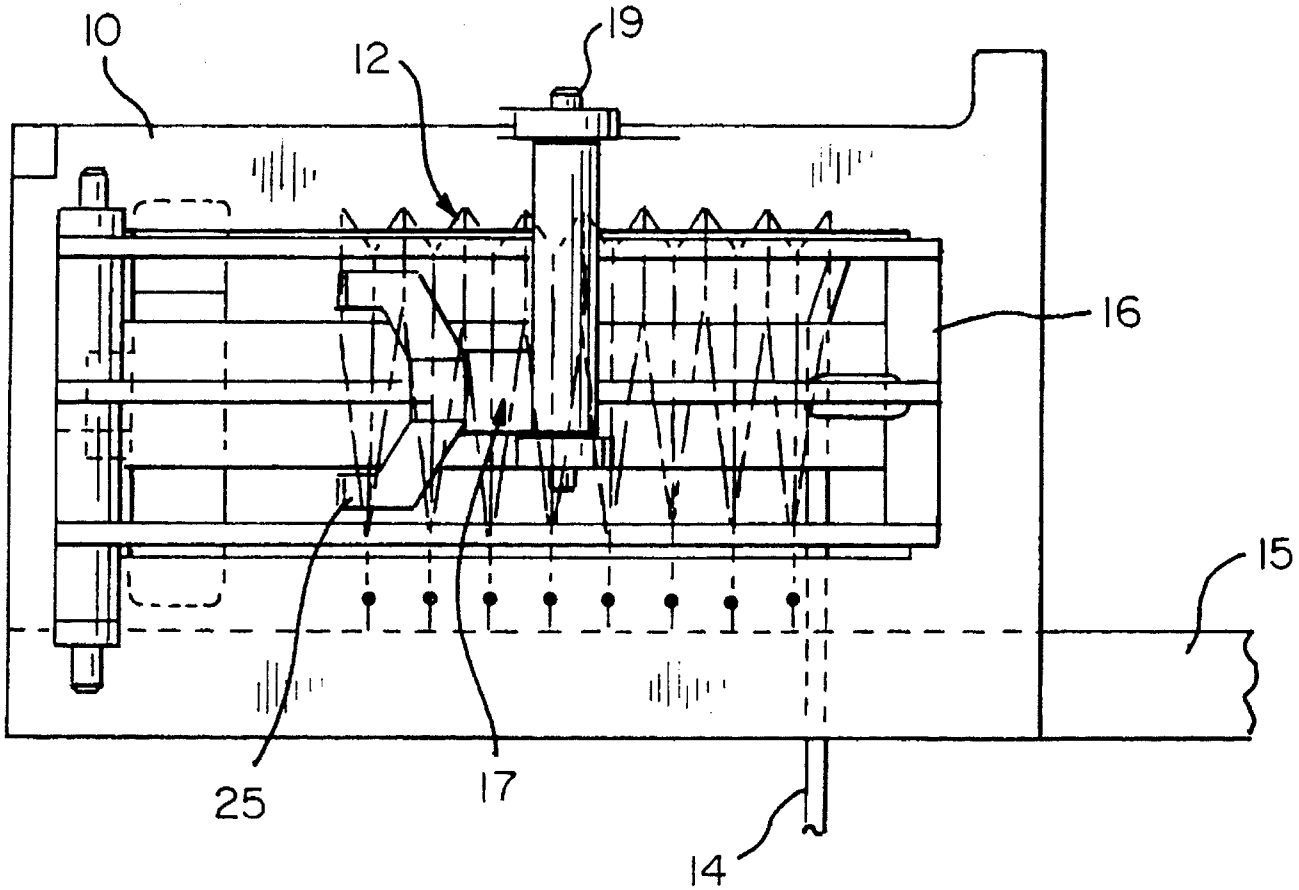
FIG. 5 shows a detail of FIG. 1.
Figure 6:
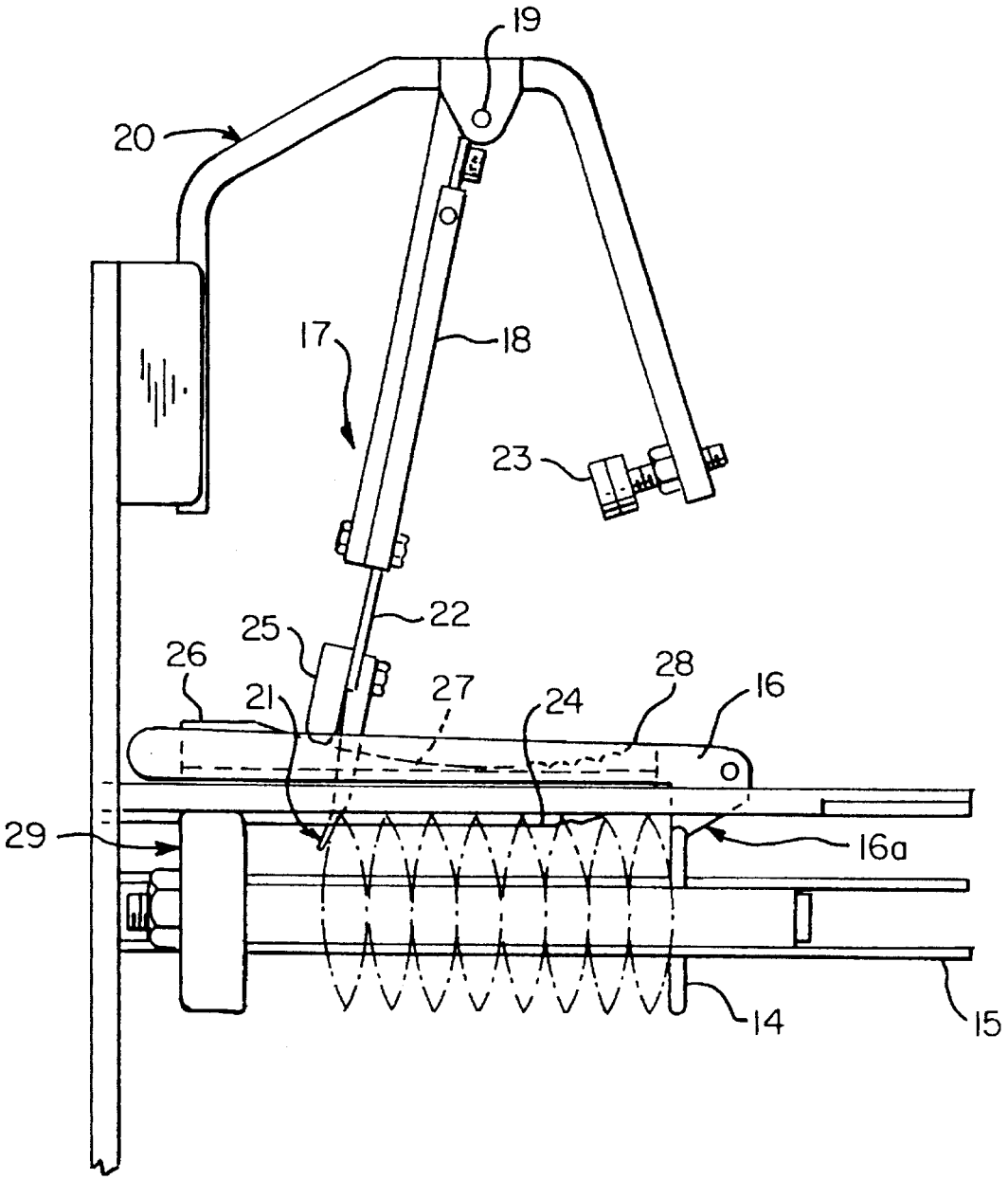
FIG. 6 shows a detail of FIG. 2.

The fingers 21, which in their operating position are extended and project from opposite sides laterally into the channel 10, form together with the retaining fingers 16 a tea bag fixation means that holds the tea bags 11 within the channel 10 in an upright position with areal abutment at one another (FIG. 6). For an improved lateral fixation of the tea bags, the sidewalls of the channel 10 are provided with additional guide rails 24. Each finger 21 has connected thereto a glide element 25 that with its inwardly (into the channel) oriented end face is recessed relative to the tips of the fingers 21 and in the extended state of the fingers 21 rests at a brake rail 26 provided at the outer wall of the channel 10 (FIGS. 5, 6). The brake rail 26 extends substantially over the entire length of the channel 10 and is preferably provided with a gliding surface 27 made of a plastic material which relative to the pivot point 19 of the arms 18 is of an arc shape. In the area of the initial position of the arms 18 the gliding surface 27 is provided preferably with a plurality of transverse grooves 28 which in width and depth are formed such that the glide element 25 can easily snap into place.

For receiving the completed stack 12 in the channel 10, a stack holder 29 and a stack pusher 30 are provided which are preferably connected to a compressed air source (not represented) and which in their rest position are located outside of the channel 10. The stack holder 29 is introduced with a piston rod 31 counter to the advancement direction of the tea bags 11 into the channel 10, while the counter movement of the stack pusher 30 is controlled by a linkage 32.

Figure 4:
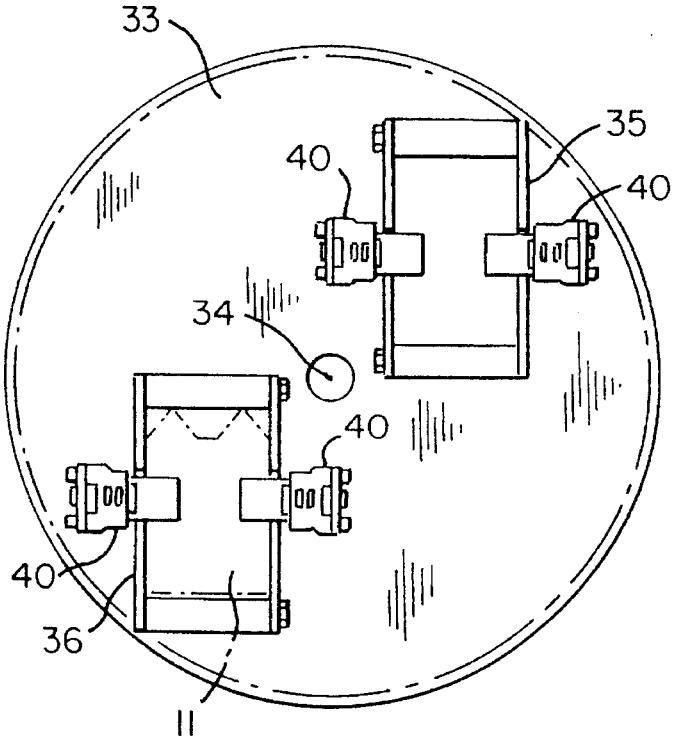
FIG. 4 shows a section along the IV—IV of FIG. 1.

Downstream of the channel 10 a rotor 33 is provided which has arranged thereon two cassettes 35, 36 which are positioned diametrically opposite to one another relative to the rotational axis 34 of the rotor 33 (FIG. 4). In the working position represented in FIG. 1, the cassette 35 is aligned with the channel 10, while the cassette 36 is in a position in which it is aligned with a transport device comprised of a further stack holder 37 and a further stack pusher 38 which are preferably pneumatically activated. The cassettes 35, 36 are provided with pairs of lateral holders 39, 40. The pair 39 arranged upstream corresponds in construction and function to the retaining fingers 16 while the downstream pair 40 is adjustable in the longitudinal direction. The two pairs 39, 40 fix the stack 12 of tea bags 11 during rotation of the cassettes. The transport device 37, 38 pushes the stack 12 into a position above a box 41 at the end of the cassette 36. Above the box 41 a pushing device 42 is provided.

The inventive device functions as follows.

The tea bags 11 which are individually gripped by the gripping device 13 and positioned on the support rail 15 so as to be upside down are pushed with the aid of the tea bag feeding device 14 past the slanted surface 16*a* of the retaining fingers 16 into the channel 10 where they are fixed in an upright position by the fingers 21 of the tea bag holder 17 (in its initial position). The fingers 21 extend laterally into the channel 10. Tea bags 11 to be discarded are removed after transfer by the gripping device 13 and before insertion into the channel 10 via a turnout (switch) and by using compressed air. The frictional forces of the tea bag holder 17 to be overcome upon feeding tea bags into the channel 10 are adjusted such that only while a new tea bag is fed into the channel pressure is exerted onto the stack 12 of tea bags for a short period of time, while during the remaining time period a uniform and substantially pressure-free fixation of the tea bags 11 is ensured. The transverse grooves 28 in the brake rail 26 within the area of the initial position of the tea bag holder 17 are designed to provide in the initial stage of stack formation the self-dampening of the stack of tea bags that is not yet of a sufficient magnitude is replaced by an increased resistance. From a certain number of tea bags on, the stack holder 29 takes over the fixation of the stack 12 in a continuous manner so that the tea bag holder 17, before reaching the predetermined number of tea bags per stack, can return into its initial position. As soon as the desired number of tea bags per stack has been reached, the stack pusher 30 moves behind the last tea bag 11 and pushes the entire stack 12 against the friction-dampened stack holder 29 into a waiting cassette 35, 36 in which the holders 39, 40 take over fixation of the stack 12 of tea bags. Directly after the beginning of transfer of the completed stack, a new stack 12 of tea bags 11 begins to form within the channel 10 between the retaining fingers 16 and the tea bag holder 17. Simultaneously, when the stack holder 29 and stack pusher 30 are removed from the cassette 35 and are returned into their initial positions, the rotor 33 begins to turn. After rotation about 180° of the rotor 33, a free cassette 36 is again aligned with the channel 10, while the rotated cassette 35 with the completed stack 12, in which the bottom of the tea bags is now facing downwardly, is received by the second stack holder 37 and second stack pusher 38 and is pushed into position above the box 41 waiting to receive the stack and below the pushing device 42. The pushing device 42 fixes the stack laterally and secures the stack during the pushing process. Only after insertion into the box, the fixation is released and the pushing device 42 is returned into its initial position.

The present invention is, of course, in no way restricted to the specific disclosure of the specification and drawings, but also encompasses any modifications within the scope of the appended claims.

What I claim is:

1. A device for packing stacks of filled tea bags, said device comprising:

a channel having a longitudinal extension for collecting filled tea bags to form a stack;

said channel having a first end and a second end;

said channel having a first stack holder for holding the leading tea bag displaceably positioned at said second end and a first stack pusher displaceably positioned at said first end for advancing the completed stack in an advancing direction from said first end to said second end;

a rotary device positioned at said second end of said channel, said rotary device having at least two cassettes for receiving the completed stack, wherein the completed stack received in one of said at least two cassettes is rotated with said rotary device;

a transporting device, positioned at said rotary device remote from said channel, comprised of a second stack holder and a second stack pusher for transporting the completed stack, after having been rotated with said rotary device, from said rotary device into a position above a box for packing the completed stack;

a pushing device, positioned at said rotary device remote from said channel, for pushing the completed stack into the box for packing;

a tea bag feeding device for feeding individual tea bags to said first end of said channel for forming the stack, said tea bag feeding device positioned at said first end of said channel;

two oppositely arranged retaining fingers positioned at said first end of said channel; and a tea bag holder positioned in an initial position at the beginning of forming a new stack at said first end of said channel, said tea bag holder displaceable in the longitudinal direction of said channel toward said second end and retractable into said initial position, wherein the tea bags fed to said device by said tea bag feeding device are positioned between said retaining fingers and said tea bag holder.

2. A device according to claim 1, wherein said tea bag holder is friction-dampened and has two holding fingers laterally projecting into said channel from opposite sides of said channel.

3. A device according to claim 2, wherein:

each one of said holding fingers has a glide element;

said channel has on each of said opposite sides a brake rail; and each one of said glide elements is pressed onto a corresponding one of said brake rail.

4. A device according to claim 3, wherein each one of said brake rails is concave and has at an upstream end thereof in said advancing direction at least one transverse groove.

5. A device according to claim 1, wherein said tea bag holder is displaceable between said initial position and a preset end position, in which end position said tea bag holder releases the stack and returns to said initial position.

6. A device according to claim 1, wherein said first and said second stack holders are friction-dampened.

7. A device according to claim 1, wherein said channel has lateral guide rails extending in said longitudinal direction of said channel.

8. A device according to claim 1, wherein said at least two cassettes are staggered about the rotational axis of said rotor at an angular distance.

9. A device according to claim 8, wherein each one of said at least two cassettes has pairs of lateral holders wherein a first pair of said lateral holders, positioned upstream in each said cassette in said advancing direction, is stationary and a second pair of said lateral holders, positioned downstream in said advancing direction relative to said first pair, is position-adjustable in the longitudinal direction of each said cassette.

10. A device according to claim 1, further comprising a gripping device upstream of said tea bag feeding device in said advancing direction for removing the tea bags upside down from a tea package machine.

11. A device according to claim 10, further comprising a support rail positioned in the path of movement of said gripping device upstream of said channel and arranged in the same plane as a lower support surface of said channel.

* * * * *